US010140899B2

(12) United States Patent
Chun et al.

(10) Patent No.: US 10,140,899 B2
(45) Date of Patent: Nov. 27, 2018

(54) IMAGE SHIFT CONTROLLER FOR CHANGING A STARTING POSITION OF AN IMAGE AND DISPLAY DEVICE INCLUDING THE SAME

(71) Applicant: SAMSUNG DISPLAY CO., LTD., Yongin-si, Gyeonggi-do (KR)

(72) Inventors: Byung Ki Chun, Yongin-si (KR); Hyun Seuk Yoo, Yongin-si (KR); Jun Gyu Lee, Yongin-si (KR); Won Woo Jang, Yongin-si (KR); Yong Seok Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 226 days.

(21) Appl. No.: 15/133,116

(22) Filed: Apr. 19, 2016

(65) Prior Publication Data

US 2016/0321973 A1 Nov. 3, 2016

(30) Foreign Application Priority Data

Apr. 30, 2015 (KR) ..... 10-2015-0061492

(51) Int. Cl.
*G09G 3/20* (2006.01)
*G09G 3/00* (2006.01)

(52) U.S. Cl.
CPC ..... *G09G 3/007* (2013.01); *G09G 3/20* (2013.01); *G09G 3/2092* (2013.01); *G09G 2320/0257* (2013.01); *G09G 2320/045* (2013.01); *G09G 2320/046* (2013.01); *G09G 2330/027* (2013.01); *G09G 2340/0464* (2013.01)

(58) Field of Classification Search
CPC ..... G09G 3/007; G09G 3/20; G09G 3/2092
USPC ..... 345/56
See application file for complete search history.

(56) References Cited

U.S. PATENT DOCUMENTS

2005/0018046 A1* 1/2005 Tsuzuki ..... G09G 3/007 348/173
2005/0204313 A1* 9/2005 Enoki ..... G09G 3/007 348/173
2007/0019007 A1* 1/2007 Jung ..... G09G 3/007 345/698
2007/0096767 A1* 5/2007 Tsai ..... G09G 3/007 324/760.01

(Continued)

FOREIGN PATENT DOCUMENTS

EP 1486939 A2 12/2004
KR 10-2004-0026059 A 3/2004

(Continued)

OTHER PUBLICATIONS

EPO Extended Search Report dated Aug. 29, 2016, for corresponding European Patent Application No. 16167781.0 (8 pages).

*Primary Examiner* — Adam J Snyder
(74) *Attorney, Agent, or Firm* — Lewis Roca Rothgerber Christie LLP

(57) ABSTRACT

An image shift controller and a display device including the same, the image shift controller including a starting position generator configured to generate image position information using sample data of first image data, and a shift determiner configured to determine a movement direction and a movement amount of an image using the image position information.

16 Claims, 7 Drawing Sheets

(56) References Cited

U.S. PATENT DOCUMENTS

| | | | | |
|---|---|---|---|---|
| 2007/0236410 | A1* | 10/2007 | Shimizu | G09G 3/20 345/20 |
| 2008/0174518 | A1* | 7/2008 | Sakuragi | G09G 3/22 345/10 |
| 2008/0180452 | A1 | 7/2008 | Lee et al. | |
| 2011/0043551 | A1* | 2/2011 | Kikuta | G09G 3/3233 345/691 |
| 2012/0287133 | A1* | 11/2012 | Lee | G09G 5/14 345/428 |
| 2014/0160043 | A1 | 6/2014 | Hwang et al. | |
| 2016/0320916 | A1 | 11/2016 | Chun et al. | |

FOREIGN PATENT DOCUMENTS

| | | | |
|---|---|---|---|
| KR | 10-2012-0109165 | A | 10/2012 |
| KR | 10-2014-0074561 | A | 6/2014 |
| KR | 10-2016-0129983 | | 11/2016 |

* cited by examiner

FIG. 5

| Bds | E1 | E2 | E3 | E4 | E5 | PI |
|---|---|---|---|---|---|---|
| 1 | 1 | 0 | 0 | 0 | 0 | 10000 |
| | 1 | 1 | 0 | 0 | 0 | 11000 |
| | 1 | 1 | 1 | 0 | 0 | 11100 |
| | 1 | 1 | 1 | 1 | 0 | 11110 |
| | 1 | 1 | 1 | 1 | 1 | 11111 |

FIG. 6

LUT

| PI | [(SDx)SQx, (SDy)SQy] |
|---|---|
| ⋮ | ⋮ |
| 10000 | [(+)1, (+)2] |
| 10001 | [(+)1, (−)3] |
| 10010 | [(−)5, (+)5] |
| 10011 | [(−)4, (−)3] |
| ⋮ | ⋮ |

FIG. 8A

Di1

| | | | | | | | | | | |
|---|---|---|---|---|---|---|---|---|---|---|
| 10 | 0 | 0 | 0 | 0 | 0 | 0 | 0 | 0 | 0 | 0 |
| 9 | 0 | 0 | 0 | 0 | 0 | 0 | 0 | 0 | 0 | 0 |
| 8 | 0 | 0 | 0 | 0 | 0 | 0 | 0 | 0 | 0 | 0 |
| 7 | 0 | 0 | 0 | 0 | 0 | 0 | 0 | 0 | 0 | 0 |
| 6 | 0 | 0 | 0 | 0 | 0 | 0 | 0 | 0 | 0 | 0 |
| 5 | 0 | 0 | 0 | 0 | 0 | 0 | 0 | 0 | 0 | 0 |
| 4 | 0 | 0 | 0 | 0 | 0 | 0 | 150 | 150 | 150 | 120 |
| 3 | 0 | 0 | 0 | 0 | 0 | 0 | 150 | 160 | 150 | 120 |
| 2 | 0 | 0 | 0 | 0 | 0 | 0 | 0 | 140 | 100 | 120 |
| 1 | 0 | 0 | 0 | 0 | 0 | 0 | 0 | 100 | 100 | 120 |
| y/x | 1 | 2 | 3 | 4 | 5 | 6 | 7 | 8 | 9 | 10 |

FIG. 8B

Di2

| | | | | | | | | | | |
|---|---|---|---|---|---|---|---|---|---|---|
| 10 | 0 | 0 | 0 | 0 | 0 | 0 | 0 | 0 | 0 | 0 |
| 9 | 0 | 150 | 150 | 150 | 120 | 0 | 0 | 0 | 0 | 0 |
| 8 | 0 | 150 | 160 | 150 | 120 | 0 | 0 | 0 | 0 | 0 |
| 7 | 0 | 0 | 140 | 100 | 120 | 0 | 0 | 0 | 0 | 0 |
| 6 | 0 | 0 | 100 | 100 | 120 | 0 | 0 | 0 | 0 | 0 |
| 5 | 0 | 0 | 0 | 0 | 0 | 0 | 0 | 0 | 0 | 0 |
| 4 | 0 | 0 | 0 | 0 | 0 | 0 | 0 | 0 | 0 | 0 |
| 3 | 0 | 0 | 0 | 0 | 0 | 0 | 0 | 0 | 0 | 0 |
| 2 | 0 | 0 | 0 | 0 | 0 | 0 | 0 | 0 | 0 | 0 |
| 1 | 0 | 0 | 0 | 0 | 0 | 0 | 0 | 0 | 0 | 0 |
| Y/X | 1 | 2 | 3 | 4 | 5 | 6 | 7 | 8 | 9 | 10 |

IMAGE SHIFT CONTROLLER FOR CHANGING A STARTING POSITION OF AN IMAGE AND DISPLAY DEVICE INCLUDING THE SAME

CROSS-REFERENCE TO RELATED APPLICATION

This application claims priority to, and the benefit of, Korean Patent Application No. 10-2015-0061492, filed on Apr. 30, 2015, in the Korean Intellectual Property Office, the entire contents of which are incorporated herein by reference in their entirety.

BACKGROUND

1. Field

Embodiments of the present invention relate to an image shift controller and a display device including the same.

2. Description of the Related Art

Various display devices, such as an organic light emitting display device (OLED), a liquid crystal display device (LCD), and a plasma display device, are widely used. In these display devices, as driving time increases, pixels may deteriorate in that their performance may deteriorate. For example, because a digital information display device used for transmitting information may continuously output a specific image or character for an extended length of time, deterioration of pixels corresponding to the image/character may be accelerated when compared to other pixels of the display device, thereby causing an afterimage, or "ghosting," to be generated on the display.

To solve the above problem, there is implemented technology (e.g., pixel shift technology) of moving or shifting an image on a display panel in a uniform period, and displaying the moved/shifted image. When the image is moved on the display panel in the uniform period and then displayed, it is possible to prevent the same data from being output to the same specific pixel(s) for an extended length of time, and to thereby reduce a deterioration rate of the specific pixel(s). However, in conventional pixel shift technology, when an image is moved from an initial position in a previously set direction, once the display panel is turned off and then turned on again, the image will be moved from the initial position in the same previously set direction. Therefore, according to conventional pixel shift technology, because the image is repeatedly moved along the same partial period, afterimage correcting effect is imperfect.

To improve this afterimage correcting effect, a method of providing an additional memory, and storing an image position in the memory at uniform time intervals is suggested. Accordingly, when the display panel is turned off and then turned on again, the stored image position is read from the memory, and the image may be moved from the position (e.g., in a different direction than before). However, this method requires an additional memory, and also requires an interface for the memory.

SUMMARY

An embodiment of the present invention relates to an image shift controller capable of changing a starting position of an image without using an additional memory, and a display device including the same.

An image shift controller according to an embodiment of the present invention includes a starting position generator configured to generate image position information using sample data of first image data, and a shift determiner configured to determine a movement direction and a movement amount of an image using the image position information.

The starting position generator may include a first flip flop configured to receive a partial bit of the sample data, and a plurality of second flip flops configured to receive output signals of a respective preceding one of the first and second flip flops.

The image position information may include a combination of signals output from of the first and second flip flops.

The output signals of the first and second flip flops may respectively have a value of 0 or 1.

The partial bit of the sample data may be a least significant bit (LSB) of the sample data.

The starting position generator may include a first flip flop unit including a first flip flop configured to receive a partial bit of first sample data, and a plurality of second flip flops configured to receive output signals of a respective preceding one of the first and second flip flops, a second flip flop unit including a third flip flop configured to receive a partial bit of second sample data, and a plurality of fourth flip flops configured to receive output signals of a respective preceding one of the third and fourth flip flops, a third flip flop unit including a fifth flip flop configured to receive a partial bit of third sample data, and a plurality of sixth flip flops configured to receive output signals of a respective preceding one of the fifth and sixth flip flops, and a selecting unit configured to select a signal output from the first flip flop unit, the second flip flop unit, or the third flip flop unit, and configured to output the selected signal as the image position information.

The first sample data may be red image data, the second sample data may be green image data, and the third sample data may be blue image data.

The selecting unit may be configured to receive one or more signals output from the first and second flip flops as a control signal, and may be configured to select the signal output from the first flip flop unit, the second flip flop unit, or the third flip flop unit in response to the control signal.

The shift determiner may be configured to determine the movement direction and the movement amount of the image corresponding to the image position information by using equations or a look-up table (LUT).

A display device according to an embodiment of the present invention includes a display panel, an image shift controller configured to determine a movement direction and a movement amount of an image, an image corrector configured to correct first image data to second image data to reflect the movement direction and the movement amount of the image, and a display driver configured to control the display panel to display the image corresponding to the second image data, wherein the image shift controller includes a starting position generator configured to generate image position information by using sample data of the first image data, and a shift determiner configured to determine the movement direction and the movement amount of the image by using the image position information.

The starting position generator may include a first flip flop configured to receive a partial bit of the sample data, and a plurality of second flip flops configured to receive output signals of a respective preceding one of the first and second flip flops.

The image position information may include a combination of signals output from the first and second flip flops.

The output signals of the first and second flip flops may respectively have a value of 0 or 1.

The partial bit of the sample data may be a least significant bit (LSB) of the sample data.

The starting position generator may include a first flip flop unit including a first flip flop configured to receive a partial bit of first sample data, and a plurality of second flip flops configured to receive output signals of a respective preceding one of the first and second flip flops, a second flip flop unit including a third flip flop configured to receive a partial bit of second sample data, and a plurality of fourth flip flops configured to receive output signals of a respective preceding one of the third and fourth flip flops, a third flip flop unit including a fifth flip flop configured to receive a partial bit of third sample data, and a plurality of sixth flip flops configured to receive output signals of a respective preceding one of the fifth and sixth flip flops, and a selecting unit configured to select a signal output from the first flip flop unit, the second flip flop unit, or the third flip flop unit, and configured to output the selected signal as the image position information.

The first sample data may be red image data, the second sample data may be green image data, and the third sample data may be blue image data.

The selecting unit may be configured to receive one or more signals output from the first and second flip flops as a control signal, and may be configured to select the signal output from the first flip flop unit, the second flip flop unit, or the third flip flop unit in response to the control signal.

The shift determiner may be configured to determine the movement direction and the movement amount of the image corresponding to the image position information by using equations or a look-up table (LUT).

As described above, according to the embodiment of the present invention, it is possible to provide the image shift controller capable of changing a starting position of an image without using an additional memory, and the display device including the same.

BRIEF DESCRIPTION OF THE DRAWINGS

Example embodiments will now be described more fully hereinafter with reference to the accompanying drawings, wherein:

FIG. 5 is a table illustrating an operation of the starting position generator according to an embodiment of the present invention;

FIG. 6 is a table illustrating an operation of the shift determiner according to an embodiment of the present invention;

FIGS. 8A and 8B are views illustrating an operation of the image corrector according to an embodiment of the present invention.

DETAILED DESCRIPTION

Figure 1:
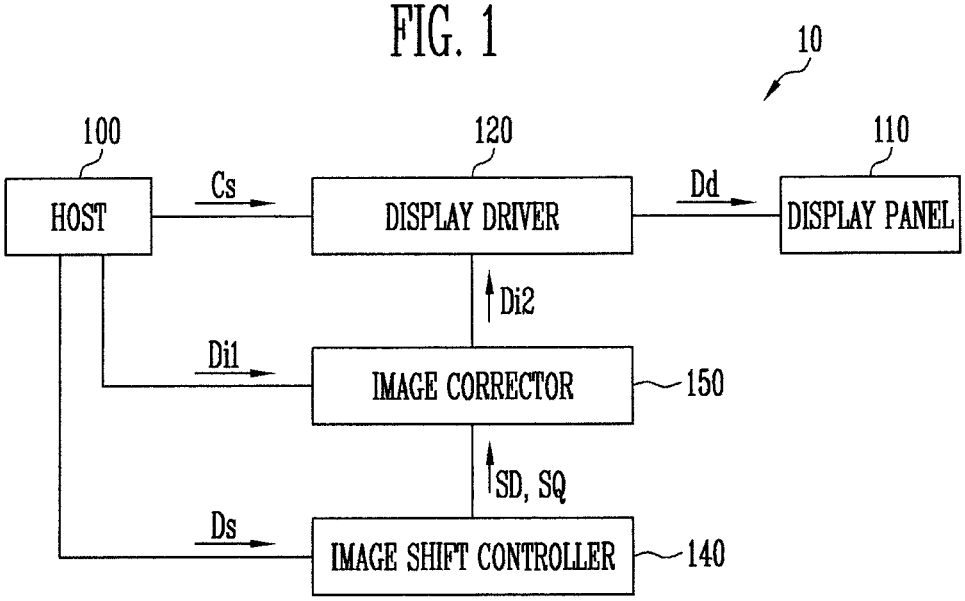
FIG. 1 is a view illustrating a display device according to an embodiment of the present invention.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including,"

when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, an image shift controller according to an embodiment of the present invention, and a display device including the same will be described with reference to the accompanying drawings.

Figure 2:
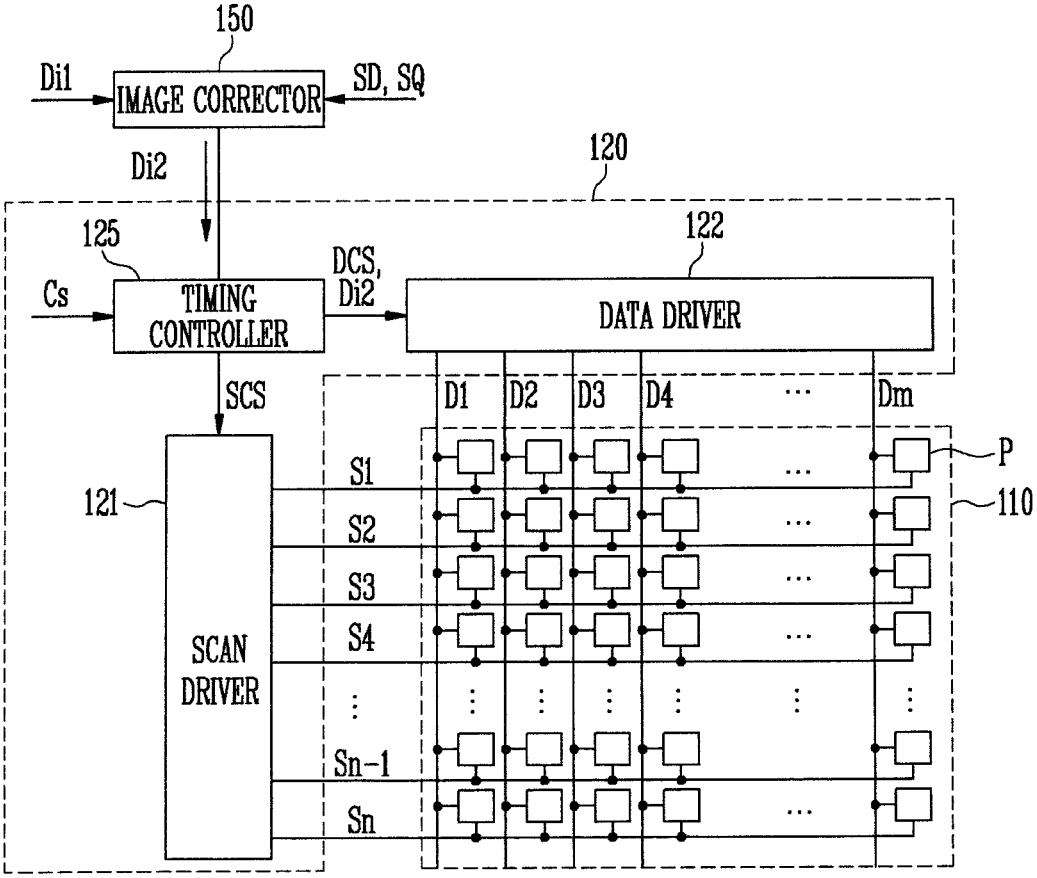
FIG. 2 is a view illustrating a display panel, a display driver, and an image corrector according to an embodiment of the present invention.

FIG. 1 is a view illustrating a display device 10 according to an embodiment of the present invention, and FIG. 2 is a view illustrating a display panel, a display driver, and an image corrector according to an embodiment of the present invention.

Referring to FIG. 1, the display device 10 according to the present embodiment may include a host 100, a display panel 110, a display driver 120, an image shift controller 140, and an image corrector 150.

The host 100 may supply first image data Di1 to the image corrector 150, and may additionally supply the first image data Di1 to the display driver 120. The host 100 may supply a control signal Cs to the display driver 120, and may additionally supply the control signal Cs to the image shift controller 140 and the image corrector 150. The control signal Cs may include a vertical synchronization signal, a horizontal synchronization signal, a data enable signal, and a clock signal.

The host 100 may supply sample data Ds to the image shift controller 140. The sample data Ds may be a part of the first image data Di1. For example, the sample data Ds may be red image data, green image data, or blue image data that is to be supplied to a specific pixel. Further, the host 100 may include a processor, a graphic processing unit, and a memory.

The display panel 110 includes a plurality of pixels P, and may display a predetermined image. For example, the display panel 110 may display an image in accordance with control of the display driver 120. In addition, the display panel 110 may be implemented by an organic light emitting display panel, a liquid crystal display panel, and/or a plasma display panel, although the present invention is not limited thereto.

The display driver 120 is configured to supply a driving signal Dd to the display panel 110, and may control an image display operation of the display panel 110. For example, the display driver 120 may generate the driving signal Dd by using image data Di1 and Di2 and the control signal Cs, which are externally supplied.

Further, the display driver 120 may be configured to receive the second image data Di2 from the image corrector 150, and may display an image moved to a specific position by using the second image data Di2. In addition, the display driver 120 may be configured to receive the first image data Di1 from the host 100 instead of the second image data Di2 from the image corrector 150, and may display an image to which a pixel shift function is not applied by using the first image data Di1, and without using the second image data Di2.

The image shift controller 140 may determine a position in which an image is to be displayed. For example, the image shift controller 140 may determine a movement direction SD of an image, and a movement amount SQ of the image.

The image corrector 150 may convert the externally supply first image data Di1 into the second image data Di2. For example, the image corrector 150 may convert the first image data Di1 into the second image data Di2 to reflect the movement direction SD and the movement amount SQ of the image, which are determined by the image shift controller 140. In addition, the image corrector 150 may supply the second image data Di2 to the display driver 120, and may receive the first image data Di1 from the host 100. The image corrector 150 may be separate from the display driver 120, or may instead be integrated with the display driver 120 or with the host 100.

Referring to FIG. 2, the display panel 110 according to the present embodiment may include a plurality of data lines D1 to Dm, a plurality of scan lines S1 to Sn, and a plurality of pixels P. The pixels P may be connected to the data lines D1 to Dm and the scan lines S1 to Sn. For example, the pixels P may be arranged in a matrix at crossing regions of the data lines D1 to Dm and the scan lines S1 to Sn, and may be configured to receive data signals and scan signals through the data lines D1 to Dm and the scan lines S1 to Sn, respectively.

The display driver 120 may include a scan driver 121, a data driver 122, and a timing controller 125. In addition, the driving signal Dd of the display driver 120 may include the scan signals and the data signals.

The scan driver 121 may be configured to supply the scan signals to the scan lines S1 to Sn in response to a scan driver control signal SCS. For example, the scan driver 121 may sequentially supply the scan signals to the scan lines S1 to Sn. The scan driver 121 may be electrically connected to the scan lines S1 to Sn positioned in the display panel 110 through an additional element (for example, a circuit board), or may instead be directly mounted in the display panel 110.

The data driver 122 is configured to receive a data driver control signal DCS and the second image data Di2 from the timing controller 125, and may be configured to generate the data signals to supply the generated data signals to the data lines D1 to Dm. The data driver 122 may be electrically connected to the data lines D1 to Dm positioned in the display panel 110 through an additional element (for example, a circuit board), or may instead be directly mounted in the display panel 110.

The pixels P that receive the data signals through respective ones of the data lines D1 to Dm may respectively emit light with a brightness corresponding to the received data signals.

The data driver 122 may be configured to receive the second image data Di2 from the timing controller 125, as illustrated in FIG. 2, or may instead receive the second image data Di2 from the image corrector 150. Therefore, the data driver 122 may supply the second image data Di2 received from the image corrector 150 to the pixels P so that the display panel 110 may display an image (for example, an image moved in a specific direction) corresponding to the second image data Di2. Further, the data driver 122 may be separated from the scan driver 121, as illustrated in FIG. 2, or may instead be integrated with the scan driver 121.

The timing controller 125 may receive the control signal Cs from the host 100, and may generate control signals for controlling the scan driver 121 and the data driver 122 based on the control signal Cs. For example, the control signals generated by the timing controller 125 may include the scan driver control signal SCS for controlling the scan driver 121 and the data driver control signal DCS for controlling the data driver 122. Therefore, the timing controller 125 may supply the scan driver control signal SCS to the scan driver 121, and may supply the data driver control signal DCS to the data driver 122.

In addition, the timing controller 125 may receive the second image data Di2 from the image corrector 150. The timing controller 125 may convert the second image data Di2 according to a specification of the data driver 122, and may supply the converted second image data Di2 to the data driver 122. The image corrector 150 may be separated from the timing controller 125, as illustrated in FIG. 2, or the image corrector 150 may instead be integrated with the timing controller 125.

According to another embodiment, the timing controller 125 is configured to receive the first image data Di1 from the host 100, and may transmit the first image data Di1 to the image corrector 150, in which case the image corrector 150 would not need to receive the first image data Di1 from the host 100.

Figure 3:
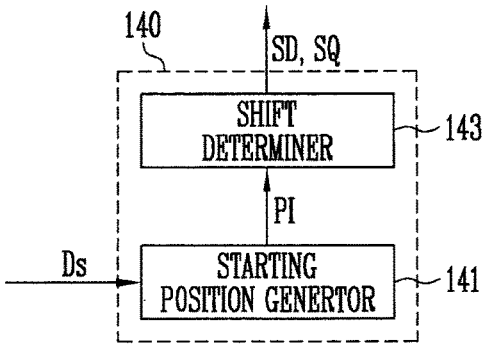
FIG. 3 is a view illustrating an image shift controller according to an embodiment of the present invention.
Figure 4:
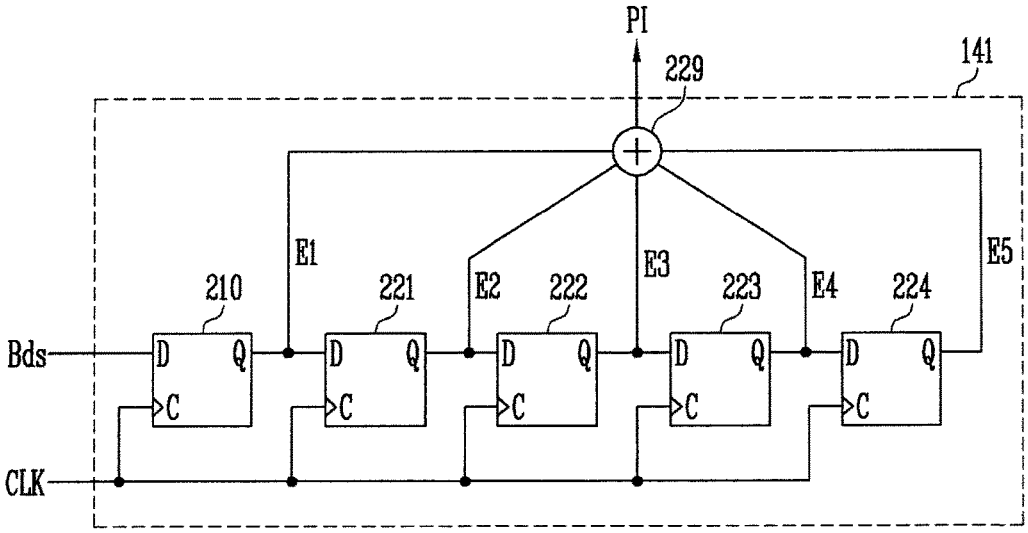
FIG. 4 is a view illustrating a starting position generator according to an embodiment of the present invention.

FIG. 3 is a view illustrating an image shift controller according to an embodiment of the present invention, and FIG. 4 is a view illustrating a starting position generator according to an embodiment of the present invention.

Referring to FIGS. 3 and 4, the image shift controller 140 according to the present embodiment may determine a position in which an image is to be displayed (for example, a movement direction SD and a movement amount SQ of an image) in real time without using an additional memory. For this purpose, the image shift controller 140 according to the present embodiment may include a starting position generator 141, and a shift determiner 143.

The starting position generator 141 may generate image position information PI by using partial data (e.g., sample data Ds) included in the first image data Di1. For this purpose, the starting position generator 141 according to the present embodiment may include a plurality of flip flops 210, 221, 222, 223, and 224, which may correspond to a first flip flop 210 and a plurality of second flip flops 221, 222, 223, and 224.

The first flip flop 210 may receive the sample data Ds from a first input end D. For example, the first flip flop 210 may receive a partial bit Bds of the sample data Ds through the first input end D. The partial bit Bds of the sample data Ds input to the first flip flop 210 may be the most significant bit (MSB) or the least significant bit (LSB) of the sample data Ds, or may be one of bits positioned between the MSB and the LSB of the sample data Ds.

For example, when a value of the sample data Ds is "10110," "1" (the MSB of the sample data Ds) may be input to the first flip flop 210, or "0" (the LSB of the sample data Ds) may be input to the first flip flop 210. In addition, one bit of "011" (i.e., the bits of the sample data Ds excluding the MSB and the LSB of the sample data Ds) may be input to the first flip flop 210. Because the LSB changes more frequently than the MSB, when the bit input to the first flip flop 210 is set as the LSB of the sample data Ds, randomness may be enhanced.

The plurality of second flip flops 221, 222, 223, and 224 may receive output signals of a corresponding preceding flip flop. For this purpose, output ends Q of the preceding flip flops may be connected to input ends D of respective subsequent flip flops. In addition, a clock signal CLK may be input to second input ends C of the flip flops 210, 221, 222, 223, and 224. The clock signal CLK may be supplied from the host 100.

The flip flops 210, 221, 222, 223, and 224 may output signals E1, E2, E3, E4, and E5 through the respective output ends Q in response to the partial bit Bds of the sample data Ds input to the first flip flop 210. A combination of these output signals E1, E2, E3, E4, and E5 may form the image position information PI generated by the starting position generator 141. For this purpose, the starting position generator 141 according to the present embodiment may further include a combining unit 229.

The combining unit 229 may be configured to receive the output signals E1, E2, E3, E4, and E5 from the flip flops 210, 221, 222, 223, and 224, respectively, and to combine the output signals E1, E2, E3, E4, and E5 to generate the image position information PI.

In addition, when a plurality of image position information items PI exist, the combining unit 229 is configured to select one of the plurality of image position information items PI, and to output the selected image position information PI to the shift determiner 143.

Each of the output signals E1, E2, E3, E4, and E5 of the flip flops 210, 221, 222, 223, and 224 may have a value of "0" or "1." For example, the values of the output signals E1, E2, E3, E4, and E5 output from the flip flops 210, 221, 222, 223, and 224 may respectively be "0," "1," "0," "1," and "0." The combining unit 229 may combine the output signals E1, E2, E3, E4, and E5 in the order of E1-E2-E3-E4-E5, and may generate the image position information PI having a value of "01010."

The combining unit 229 may generate the image position information PI by varying the combination order of the output signals E1, E2, E3, E4, and E5. For example, the combining unit 229 may combine the output signals E1, E2, E3, E4, and E5 in the order of E2-E4-E1-E3-E5, and may generate the image position information PI having a value of "11000."

In FIG. 4, the five flip flops 210, 221, 222, 223, and 224 are illustrated. However, the number of flip flops 210, 221, 222, 223, and 224 may vary in other embodiments of the present invention. In addition, in FIG. 4, D flip flops are illustrated. However, the type of flip flops may vary in other embodiments of the present invention.

The shift determiner 143 is configured to receive the image position information PI generated by the starting position generator 141, and may determine the movement direction SD and the movement amount SQ of the image by using the received image position information PI. For example, the shift determiner 143 may determine the movement direction SD and the movement amount SQ of the image corresponding to the image position information PI by using previously set equations or a previously stored look-up table (LUT).

FIG. 5 is a table illustrating an operation of the starting position generator 141 according to an embodiment of the present invention.

Referring to FIG. 5, the operation of the starting position generator 141 according to the present embodiment will be described. In particular, the case in which the partial bit Bds supplied to the first flip flop 210 of the starting position generator 141 is "1" will be described.

The output signals E1, E2, E3, E4, and E5 of the flip flops 210, 221, 222, 223, and 224 are respectively referred to as a first output signal E1, a second output signal E2, a third output signal E3, a fourth output signal E4, and a fifth output signal E5. Assuming that current values of the output signals E1, E2, E3, E4, and E5 are initially "0," when a value of "1" is supplied to the input end D of the first left flip flop 210, the value of the first output signal E1 changes from "0" to "1." At this time, the values of the output signals E2, E3, E4, and E5 are maintained as "0." The value of the first output signal E1 may change at a transition point (a rising edge or a falling edge) of the clock signal CLK. Therefore, in this case, the image position information PI having a value of "10000" may be generated.

As the value of the first output signal E1 changes from "0" to "1," "1" is supplied to the input end D of the second left flip flop 221. Therefore, the value of the second output signal E2 changes from "0" to "1" at a subsequent transition point of the clock signal CLK. At this time, the values of the third to fifth output signals E3, E4, and E5 are maintained as "0." Therefore, in this case, the image position information PI having the value of "11000" may be generated by the combining unit 229.

As the value of the second output signal E2 changes from "0" to "1," "1" is supplied to the input end D of the third left flip flop 222. Therefore, at a subsequent transition point of the clock signal CLK, the value of the third output signal E3 changes from "0" to "1." At this time, the values of the fourth and fifth output signals E4 and E5 are maintained as "0." Therefore, the image position information PI having a value of "11100" may be generated by the combining unit 229.

As the value of the third output signal E3 changes from "0" to "1," "1" is supplied to the input end D of the fourth left flip flop 223. Therefore, the value of the fourth output signal E4 changes from "0" to "1" at a subsequent transition point of the clock signal CLK. At this time, the value of the fifth output signal E5 is maintained as "0." Therefore, the image position information PI having a value of "11110" may be generated by the combining unit 229.

As the value of the fourth output signal E4 changes from "0" to "1," "1" is supplied to the input end D of the fifth left flip flop 224. Therefore, the value of the fifth output signal E5 changes from "0" to "1" at a subsequent transition point of the clock signal CLK. Therefore, the values of all the output signals E1, E2, E3, E4, and E5 are maintained as "1." Therefore, in this case, the image position information PI having a value of "11111" may be generated by the combining unit 229.

As described above that the combining unit 229 may generate the image position information PI having different values by varying the combination order of the output signals E1, E2, E3, E4, and E5. The plurality of image position information items PI may be generated by the above-described operations. At this time, the combining unit 229 may select one of the plurality of image position information items PI, and may output the selected image position information PI to the shift determiner 143.

FIG. 6 is a table illustrating an operation of the shift determiner 143 according to an embodiment of the present invention.

Referring to FIG. 6, the shift determiner 143 may receive the image position information PI from the starting position generator 141. At this time, the shift determiner 143 may calculate the movement direction SD and the movement amount SQ of the image corresponding to the image position information PI with reference to the previously stored LUT.

The LUT may include the image position information PI, and may include the movement direction SD and the movement amount SQ corresponding to the image position information PI. For example, the movement direction SD of the image includes an X-axis movement direction SDx and a Y-axis movement direction SDy, and the movement amount SQ of the image may include an X-axis movement amount SQx and a Y-axis movement amount SQy.

When the X-axis movement direction SDx is a positive direction (e.g., toward a right side), SDx is displayed as (+), and when the X-axis movement direction SDx is a negative direction (e.g., toward a left side), SDx is displayed as (−). Similarly, when the Y-axis movement direction SDy is a positive direction (e.g., toward an upper side), SDy is displayed as (+), and when the Y-axis movement direction SDy is a negative direction (e.g., toward a lower side), SDy is displayed as (−). It should be noted that the above is only an embodiment, and a method of expressing the movement direction SD of the image may vary.

The movement amount SQ of the image may be set based on a pixel. For example, when the X-axis movement amount SQx is set as 4, the corresponding image may move four compartments to the left or right based on the pixel. In addition, when the Y-axis movement amount SQy is set as 3, the corresponding image may move three compartments to the upper or lower side based on the pixel.

In the present embodiment, the shift determiner 143 uses the LUT. However, the shift determiner 143 may calculate the movement direction SD and the movement amount SQ of the image through equations, which may replace the LUT in other embodiments.

Figure 7:
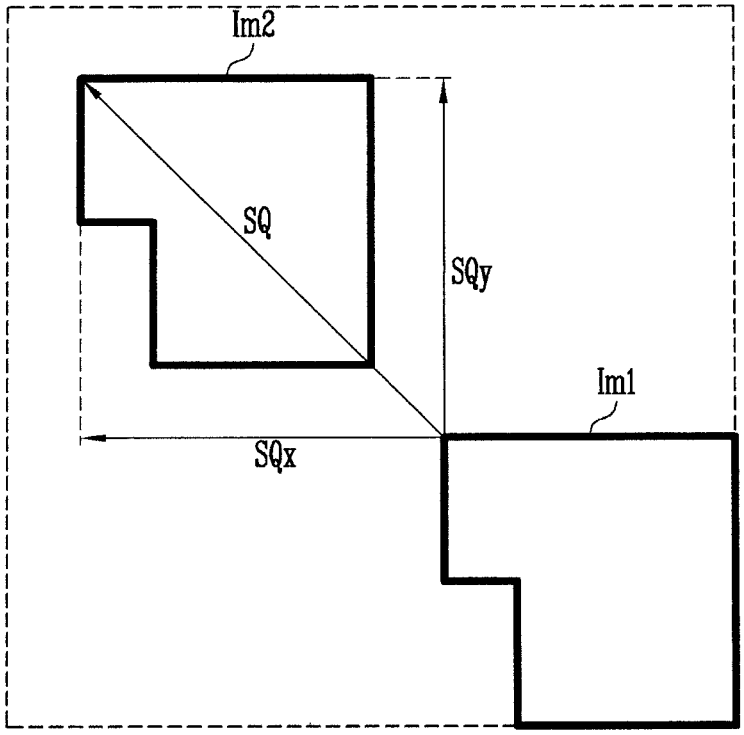
FIG. 7 is a view illustrating movement of an image according to an embodiment of the present invention.

FIG. 7 is a view illustrating movement of an image according to an embodiment of the present invention. In FIG. 7, the image is illustrated as moving in accordance with the movement direction SD and the movement amount SQ of the image calculated by the shift determiner 143. Also, a pixel shift function is not applied to a first image Im1, while a pixel shift function is applied to a second image Im2. For example, the first image Im1 may correspond to the first image data Di1, and the second image Im2 may correspond to the second image data Di2 as corrected by the image corrector 150.

For example, when the image position information PI generated by the starting position generator 141 has a value of "10010," in accordance with the LUT illustrated in FIG. 6, the X-axis movement direction SDx and the X-axis movement amount SQx are respectively calculated as "(−)" (e.g., a left side) and "5," and the Y-axis movement direction SDy and the Y-axis movement amount SQy may be respectively calculated as "(+)" (e.g., an upper side) and "5." Accordingly, the second image Im2 may move five compartments to the left and five compartments to the upper side based on the location of the first image Im1.

FIGS. 8A and 8B are views illustrating an operation of the image corrector according to an embodiment of the present invention.

The image corrector 150 according to the present embodiment may correct the first image data Di1 to the second image data Di2 to reflect the movement direction SD and the movement amount SQ of the image transmitted from the image shift controller 140.

The first image data Di1 may include a plurality of data values that may correspond to corresponding image coordinates (x,y), and the image corrector 150 may move a data value of the specific image coordinates (x,y) to corrected coordinates (X,Y) corresponding thereto.

For example, when the X-axis movement direction SDx and the X-axis movement amount SQx are respectively "(−)" and "5," and when the Y-axis movement direction SDy and the Y-axis movement amount SQy are respectively "(+)" and "5," the corrected coordinates (X,Y) may be (x−5,y+5). Therefore, a data value "160" of image coordinates (8,3) may move to corrected coordinates (3,8). The image corrector 150 may generate the second image data Di2 by moving all the data values included in the first image data Di1 to corresponding corrected coordinates (X,Y) by the above-described operation (e.g., by moving the data value "140" of image coordinates (8,2) to corrected coordinates (3,7)).

The display driver 120 may receive the second image data Di2 from the image corrector 150, and may display the second image Im2 moved in a specific direction on the display panel 110 with respect to the first image Im1 by using the second image data Di2. Therefore, a position of an image may be changed without using an additional memory.

Any image data correcting method of the image corrector 150 with the movement direction SD and the movement amount SQ of the image reflected may be used, and the image data correcting method of other embodiments of the present invention may be different from the above-described method.

Figure 9:
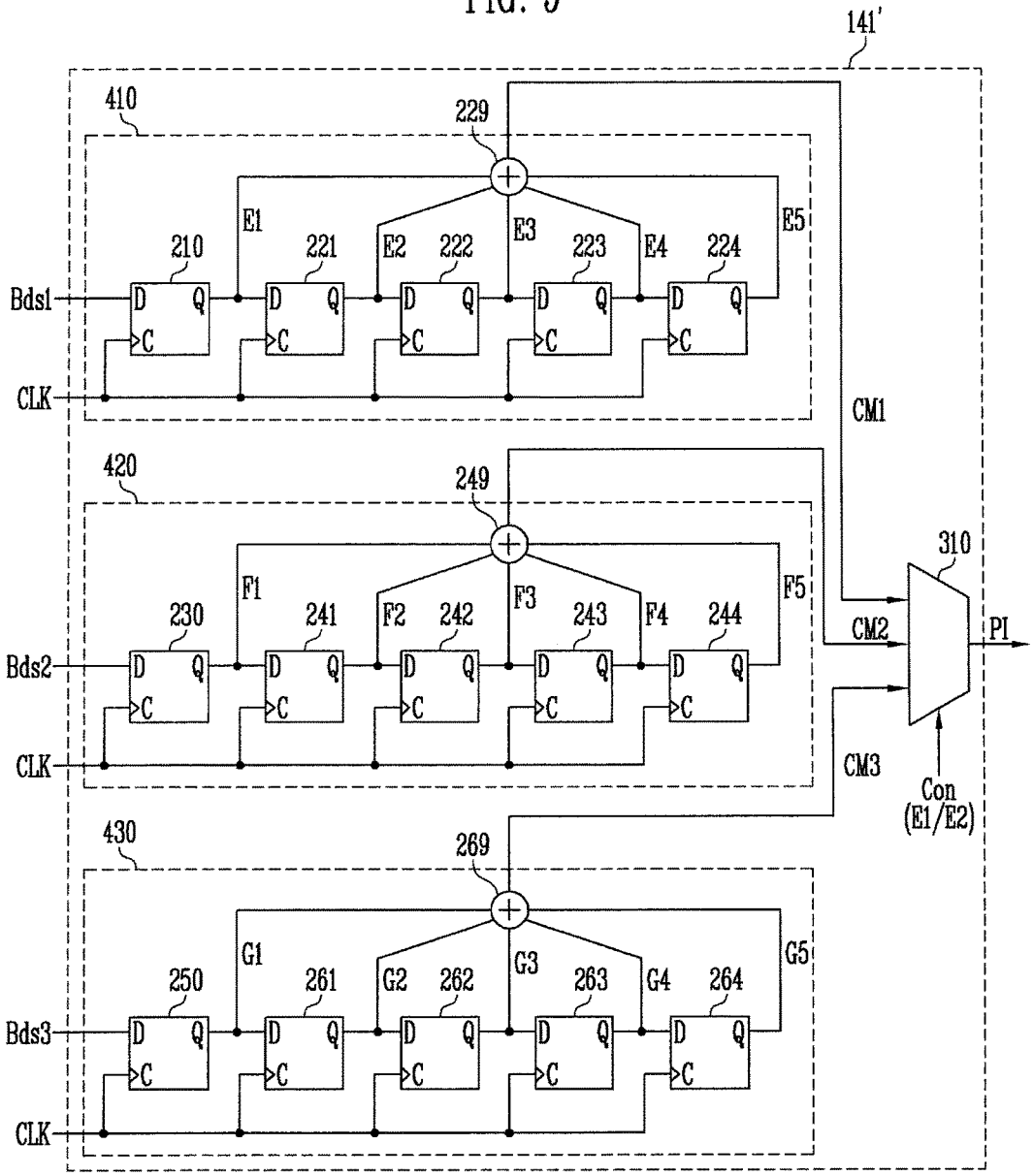
FIG. 9 is a view illustrating a starting position generator according to another embodiment of the present invention.

FIG. 9 is a view illustrating a starting position generator 141' according to another embodiment of the present invention.

The starting position generator 141' according to the present embodiment uses a larger number of sample data items than the starting position generator 141 illustrated in FIG. 4. Repeated description of the elements common to the starting position generator 141 illustrated in FIG. 4 will not be given.

Referring to FIG. 9, the starting position generator 141' may include a first flip flop unit 410 for receiving a partial bit Bds1 of first sample data, a second flip flop unit 420 for receiving a partial bit Bds2 of second sample data, and a third flip flop unit 430 for receiving a partial bit Bds3 of third sample data. In addition, the starting position generator 141' may further include additional combining units 229, 249, and 269 in order to collect signals output from the respective flip flop units 410, 420, and 430.

The first sample data, the second sample data, and the third sample data may be different from each other. For example, the first sample data may be set as red image data, the second sample data may be set as green image data, and the third sample data may be set as blue image data.

The first flip flop unit 410 may include the first flip flop 210 and the plurality of second flip flops 221, 222, 223, and 224. The first flip flop 210 may receive the partial bit Bds1 of the first sample data through the first input end D, and the plurality of second flip flops 221, 222, 223, and 224 may receive output signals of immediately preceding flip flops, respectively. For this purpose, output ends Q of the flip flops may be connected to input ends D of immediately subsequent flip flops, respectively. In addition, the clock signal CLK may be input to the second input ends C of the respective flip flops 210, 221, 222, 223, and 224.

The flip flops 210, 221, 222, 223, and 224 may respectively output the signals E1, E2, E3, E4, and E5 through respective output ends Q thereof in response to the partial bit Bds1 of the first sample data input to the first flip flop 210. The first combining unit 229 may receive the output signals E1, E2, E3, E4, and E5 from the first flip flop unit 410, and may transmit a combination signal CM1, which is generated by combining the output signals E1, E2, E3, E4, and E5, to a selecting unit 310. Because the combination signal CM1 has the same configuration as the image position information PI of the previous embodiment, the combination signal CM1 may be referred to as the image position information PI (e.g., the combination signal CM1 may be selected in a manner similar to the selection of the position information PI described with respect to FIG. 4).

In addition, the partial bit Bds1 of the first sample data input to the first flip flop 210 may be the MSB or the LSB of the first sample data, or may be one of the bits positioned between the MSB and the LSB of the first sample data.

The second flip flop unit 420 may include a third flip flop 230 and a plurality of fourth flip flops 241, 242, 243, and 244. The third flip flop 230 may receive the partial bit Bds2 of the second sample data through the first input end D, and the plurality of fourth flip flops 241, 242, 243, and 244 may receive output signals of a respective preceding flip flops. For this purpose, output ends Q of the flip flops may be connected to input ends D of immediately subsequent flip flops, respectively. In addition, the clock signal CLK may be input to the second input ends C of the respective flip flops 230, 241, 242, 243, and 244.

The flip flops 230, 241, 242, 243, and 244 may respectively output the signals F1, F2, F3, F4, and F5 through respective output ends Q thereof in response to the partial bit Bds2 of the second sample data input to the third flip flop 230. The second combining unit 249 may receive the output signals F1, F2, F3, F4, and F5 from the second flip flop unit 420, and may transmit a combination signal CM2 generated by combining the output signals F1, F2, F3, F4, and F5 to the selecting unit 310. Because the combination signal CM2 has the same configuration as the image position information PI of the previous embodiment, the combination signal CM2 may be referred to as the image position information PI (e.g., the combination signal CM2 may be selected in a manner similar to the selection of the position information PI described with respect to FIG. 4).

In addition, the partial bit Bds2 of the second sample data input to the third flip flop 230 may be the MSB or the LSB of the second sample data, or may be one of the bits positioned between the MSB and the LSB of the second sample data.

The third flip flop unit 430 may include a fifth flip flop 250 and a plurality of sixth flip flops 261, 262, 263, and 264. The fifth flip flop 250 may receive the partial bit Bds3 of the third sample data through the first input end D, and the plurality of sixth flip flops 261, 262, 263, and 264 may receive output signals of immediately preceding flip flops. For this purpose, output ends Q of the flip flops may be connected to input ends D of immediately subsequent flip flops, respectively. In addition, the clock signal CLK may be input to the second input ends C of the respective flip flops 250, 261, 262, 263, and 264.

The flip flops 250, 261, 262, 263, and 264 may respectively output signals G1, G2, G3, G4, and G5 through respective output ends Q thereof in response to the partial bit Bds3 of the third sample data input to the fifth flip flop 250. The third combining unit 269 may receive the output signals G1, G2, G3, G4, and G5 from the third flip flop unit 430, and may transmit a combination signal CM3 generated by combining the output signals G1, G2, G3, G4, and G5 to the selecting unit 310. Because the combination signal CM3 has the same configuration as the image position information PI of the previous embodiment, the combination signal CM3 may be referred to as the image position information PI (e.g., the combination signal CM3 may be selected in a manner similar to the selection of the position information PI described with respect to FIG. 4).

In addition, the partial bit Bds3 of the third sample data input to the fifth flip flop 250 may be the MSB or the LSB of the third sample data, or may be one of the bits positioned between the MSB and the LSB of the third sample data.

In FIG. 9, five flip flops are illustrated in each of the flip flop units 410, 420, and 430, although the number of flip flops in the flip flop units may vary in other embodiments of the present invention. Further, although D flip flops are illustrated, other types of flip flops may be used in other embodiments of the present invention.

The selecting unit 310 may select one of the signals CM1, CM2, and CM3 output from the first flip flop unit 410, the second flip flop unit 420, and the third flip flop unit 430 in response to a received control signal Con, and may output the selected signal as the image position information PI. As described above, the image position information PI output from the selecting unit 310 may be input to the shift determining unit 143.

The control signal Con may receive one or more of the signals E1, E2, E3, E4, and E5 output from the first flip flop unit 410 as the control signal Con. For example, the control signal Con may include the first output signal E1 and the second output signal E2. In this case, because an internally generated signal is used as the control signal Con of the selecting unit 310, it is not necessary to generate a unique control signal Con.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. An image shift controller comprising:

a starting position generator configured to generate image position information using sample data of first image data, and comprising:

a first flip flop configured to receive a partial bit of the sample data; and a plurality of second flip flops configured to receive output signals of a respective preceding one of the first and second flip flops; and a shift determiner configured to determine a movement direction and a movement amount of an image using the image position information.

2. The image shift controller of claim 1, wherein the image position information comprises a combination of signals output of the first and second flip flops.

3. The image shift controller of claim 2, wherein the output signals of the first and second flip flops respectively have a value of 0 or 1.

4. The image shift controller of claim 1, wherein the partial bit of the sample data is a least significant bit (LSB) of the sample data.

5. The image shift controller of claim 1, wherein the starting position generator comprises:

a first flip flop unit comprising a first flip flop configured to receive a partial bit of first sample data, and a plurality of second flip flops configured to receive output signals of a respective preceding one of the first and second flip flops;

a second flip flop unit comprising a third flip flop configured to receive a partial bit of second sample data, and a plurality of fourth flip flops configured to receive output signals of a respective preceding one of the third and fourth flip flops;

a third flip flop unit comprising a fifth flip flop configured to receive a partial bit of third sample data, and a plurality of sixth flip flops configured to receive output signals of a respective preceding one of the fifth and sixth flip flops; and a selecting unit configured to select a signal output from the first flip flop unit, the second flip flop unit, or the third flip flop unit, and configured to output the selected signal as the image position information.

6. The image shift controller of claim 5, wherein the first sample data is red image data, wherein the second sample data is green image data, and wherein the third sample data is blue image data.

7. The image shift controller of claim 5, wherein the selecting unit is configured to receive one or more signals output from the first and second flip flops as a control signal, and is configured to select the signal output from the first flip flop unit, the second flip flop unit, or the third flip flop unit in response to the control signal.

8. The image shift controller of claim 1, wherein the shift determiner is configured to determine the movement direction and the movement amount of the image corresponding to the image position information by using equations or a look-up table (LUT).

9. A display device comprising:

a display panel;

an image shift controller configured to determine a movement direction and a movement amount of an image;

an image corrector configured to correct first image data to second image data to reflect the movement direction and the movement amount of the image; and a display driver configured to control the display panel to display the image corresponding to the second image data, wherein the image shift controller comprises:

a starting position generator configured to generate image position information by using sample data of the first image data, and comprising:

a first flip flop configured to receive a partial bit of the sample data; and a plurality of second flip flops configured to receive output signals of a respective preceding one of the first and second flip flops; and a shift determiner configured to determine the movement direction and the movement amount of the image by using the image position information.

10. The display device of claim 9, wherein the image position information comprises a combination of signals output from the first and second flip flops.

11. The display device of claim 9, wherein the output signals of the first and second flip flops respectively have a value of 0 or 1.

12. The display device of claim 9, wherein the partial bit of the sample data is a least significant bit (LSB) of the sample data.

13. The display device of claim 9, wherein the starting position generator comprises:

a first flip flop unit comprising a first flip flop configured to receive a partial bit of first sample data, and a plurality of second flip flops configured to receive output signals of a respective preceding one of the first and second flip flops;

a second flip flop unit comprising a third flip flop configured to receive a partial bit of second sample data, and a plurality of fourth flip flops configured to receive output signals of a respective preceding one of the third and fourth flip flops;

a third flip flop unit comprising a fifth flip flop configured to receive a partial bit of third sample data, and a plurality of sixth flip flops configured to receive output signals of a respective preceding one of the fifth and sixth flip flops; and a selecting unit configured to select a signal output from the first flip flop unit, the second flip flop unit, or the third flip flop unit, and configured to output the selected signal as the image position information.

14. The display device of claim 13, wherein the first sample data is red image data, wherein the second sample data is green image data, and wherein the third sample data is blue image data.

15. The display device of claim 13, wherein the selecting unit is configured to receive one or more signals output from the first and second flip flops as a control signal, and is configured to select the signal output from the first flip flop unit, the second flip flop unit, or the third flip flop unit in response to the control signal.

16. The display device of claim 9, wherein the shift determiner is configured to determine the movement direction and the movement amount of the image corresponding to the image position information by using equations or a look-up table (LUT).

* * * * *